US005164251A

United States Patent [19]

Davis et al.

[11] Patent Number: 5,164,251

[45] Date of Patent: Nov. 17, 1992

[54] PAPER MACHINE FELTS

[75] Inventors: Robert B. Davis, Framingham; Charles E. Kramer, Walpole; Sandra K. Barlow, Blackstone, all of Mass.

[73] Assignee: Albany International Corp., Albany, N.Y.

[21] Appl. No.: 768,582

[22] PCT Filed: Nov. 28, 1990

[86] PCT No.: PCT/GB90/01846

§ 371 Date: Sep. 19, 1991

§ 102(e) Date: Sep. 19, 1991

[87] PCT Pub. No.: WO91/08340

PCT Pub. Date: Jun. 13, 1991

[30] Foreign Application Priority Data

Nov. 29, 1989 [GB] United Kingdom ..... 8927020

[51] Int. Cl.[5] ..... B32B 5/02

[52] U.S. Cl. ..... 428/234; 428/280; 428/287; 428/300

[58] Field of Search ..... 428/233, 234, 280, 300, 428/287; 162/DIG. 1, 358

[56] References Cited

U.S. PATENT DOCUMENTS 4,874,660 10/1989 Davis et al. ..... 428/234

*Primary Examiner*—James J. Bell

*Attorney, Agent, or Firm*—Ostrolenk, Faber, Gerb & Soffen

[57] ABSTRACT

The present invention relates to a felt for use in papermaking machines showing enhanced resistance to degradation in the presence of peroxide which felt comprises a woven base and a sheet contracting layer attached thereto characterized in that at least one of said layer and said woven base comprises fibers of polyamide 12, 12 found by extrusion of a melt of polyamide 12, 12 having intrinsic viscosity of not less than 0.65 dl/gram.

8 Claims, 2 Drawing Sheets

GF-ranking

GF-ranking

PEROXIDE-degraded fibre

PAPER MACHINE FELTS

DESCRIPTION

Figure 1:
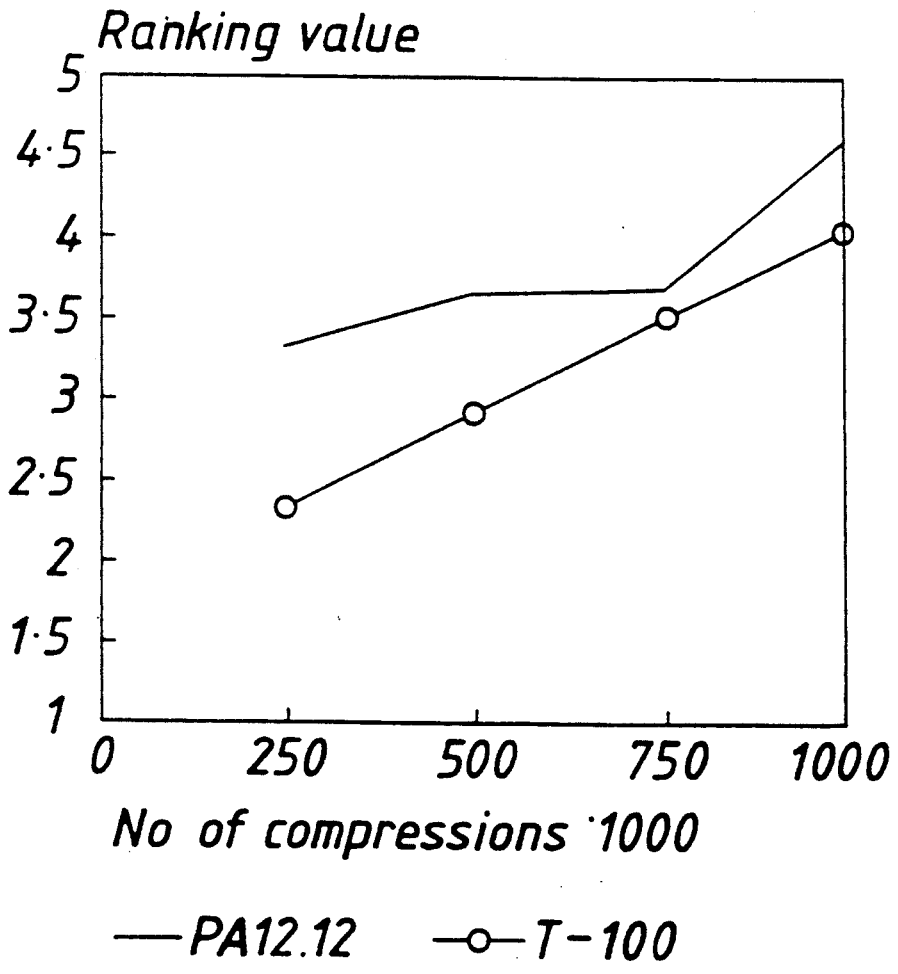

This invention relates to paper machine felts. In a paper making machine, a slurry of paper making constituents referred to as "furnish" is deposited on a fabric or "wire" and the liquid constituent is drawn or extracted therethrough to produce a self-cohesive sheet which is then passed to the pressing and drying sections of a paper making machine. In the pressing section, the paper sheet is transported by a felt to a pair of rollers where the felt and paper sheet pass between the nip of the rollers to dewater and to initiate drying of the paper sheet. The paper sheet itself may contain all types of chemical additives and in particular contains a considerable amount of residual bleach or peroxide which were added in the pulping process to whiten or enhance the whiteness of the final paper produced. The paper sheet, at the same time, will be subjected to elevated temperatures to aid the dewatering and drying thereof; the paper making felt together with its sheet tend, therefore, to be subjected to immense pressure at elevated temperatures in a rigorous chemical environment.

Polyamide 6 and polyamide 6,6 (PA-6, PA-6,6) have been used extensively in the manufacture of paper machine felts. These polymers are readily formable as fibres and their fibre characteristics can be controlled to make acceptable felts. Many prior art proposals for the use of polyamide materials in sheet and felt materials in general have been proposed. In British Patent Specification No. 1304732, for example, there is a reference to the use of polyamides such as nylon 6, nylon 6-6, nylon 6-10, nylon 7, nylon 8, nylon 9, nylon 11 and nylon 12. The specification is concerned with the manufacture of a fibre sheet material and is not specifically concerned with paper machine clothing.

British Patent Specification No. 1329132 again relates to a non-woven fabric for use, for example, as an interlining. Again, there is reference to the use of polyamides such as nylon 6, nylon 11, nylon 12 and copolyamides such as nylon 6/66 and copolymers of nylon 6 and nylon 66 with nylon 11 or nylon 12. British Patent Specification No. 1585632 has been concerned with the manufacture of artificial leather and like materials and again, the use of nylon 6, nylon 6-6, nylon 10, nylon 11 and nylon 12 are disclosed together with various copolymers of different variations and combinations thereof.

In each of these cases referred to the nylon materials are used primarily for their inherent strength in a cloth or decorative assembly and would not be subjected to the aggressive physical and chemical environment of a paper making machine.

European Patent Specification No. 0070708 relates to a paper making felt comprising a woven heat set belt in the machine and in the transverse direction of thermoplastic filaments in which the filaments in at least one of the machine and transverse directions are co-extruded and monofilaments having a core of a polymer selected from nylon 6-6, polyethylene terephthalate and a terpolymer of a tere- or isophthalic acid and a sheet of a copolymer selected from nylon 11, nylon 12, nylon 6, nylon 6,10, nylon 6,12, polybutylene terephthalate and a large number of other materials.

In European Patent Specification No. 0070708 the materials are employed principally for their well known properties of strength and abrasion resistance.

At the present time industry standard felts are produced from both polyamide-6 and 6,6 material. Such materials have been found over the years to produce consistent results. As the papermaking process becomes more efficient, the process requires the presence of increasing amounts of hydrogen peroxide or chlorine, particularly when the paper concerned has a proportion of re-cycled pulp. These aggressive chemicals subject the polyamide material to extreme degradation with a result that the life of the felt correspondingly decreases. Thus, improvements in process efficiency are counterbalanced by shorter felt life.

Papermaking felts are generally produced by needling batt fibre to a woven backing which then support the forming paper sheets through the press. In the nip of the press rolls these batt fibres are bent and deformed under great pressure and at great frequency; thus the mechanical properties of the fibres of the batt are of considerable importance in such processes. These mechanical properties for polyamide-6 materials currently in use in the papermaking industry fall off rapidly in the presence of significant quantities of hydrogen peroxide or chlorine.

Furthermore, as paper machine technology improves, speeds, operating temperatures and pressures increase with a result that the tendency of existing felts to flatten is also increased. Further, increased degradation with increasing temperature of operation and increasing speed of the machine results in a still shorter service life of paper machine felts.

Surprisingly, however, the present applicants have found that by using a polyamide 12-12 fibre in the construction of their paper machine felt, a felt is obtained having enhanced resistance to degradation in a vigorous chemical environment.

According to one aspect of the present invention, therefore, there is provided a felt for use in a papermaking machine comprising a woven base and at least one sheet contacting layer of fibre material attached thereto characterized in that at one of said fibre material layer and said woven base material comprises fibres of polyamide-12,12 formed by the extrusion of a melt polyamide-12,12 having an intrinsic viscosity of not less than 0.65 dl/g.

In a further aspect of the present invention the melt may contain 0.2 to 1.0% by weight of antioxidant, and more preferably 0.4 to 0.6%. The antioxidant may be selected from alpha-tocopherol and related structures or condensation products of diphenylamine and acetone and of diphenylamine and a compatible phenolic stabilizer with amide functionality such, for example, as that commercially available from Messrs Ciba Geigy under the trade name "Irganox 1098". In a further, aspect of the present invention the fibre, prior to extrusion, may contain 0.5 to 0.7% by weight of one or more of the specific antioxidant referred to above.

The polyamide-12,12 resin of the appropriate molecular weight identified by the particular intrinsic viscosity value in accordance with the present invention may be compounded during the extrusion of monofilament or continuous filament by the addition of the selected antioxidant at the time of extrusion. A PA-12,12 monofilament with antioxidant compound may be extruded at temperatures across the barrel between 184° C. and 221° C. The spinneret may be maintained at a temperature of approximately 225° C. Monofilament may be extruded with drawdown between 2.0X and 4.5X in order to provide monofilaments of 0.1–0.25 mm for the manufacture of Fourdrinier or other forming fabrics. The improved properties which accrued to the use of polyamide-12,12 can also be obtained in accordance with the present invention by using polyamide-12,12 monofilament as shute filaments or warp filaments in single, double or triple layer forming fabrics. It is also possible to use both the shute and warp filaments formed of this material.

In a further aspect of the present invention there is provided a Fourdrinier forming fabric in which at least the warp or shute filament may be formed by PA-12,12 high molecular weight monofilament which has been extruded from a PA-12,12 melt having intrinsic viscosity when measured in concentrated sulfuric acid of 0.65 dl/g or more.

It is thus possible in accordance with the invention to prepare high durability, all polyamide forming fabrics and to avoid the mix of materials hitherto employed whereby polyester monofilaments are inserted in the shute direction alternatively with polyester in order to provide a measure of enhanced abrasion resistance, thereby overcoming the inherent dimensional instability resulting from the use of PA-6 or PA-6,6 materials currently employed. PA-12,12 has a low moisture regain (less than 1% mass on mass) and is relatively insensitive to physical property changes in the presence of water. Monofilaments of PA-12,12 can be extruded with variations in the process to deliver desirable tensile properties for the weaving of base fabrics capable of receiving a needled non-woven card web employed in the pressing section of a paper making machine. Monofilament in larger diameter can be employed in both warp and shute directions in dryer screen applications. Fine denier filaments of high molecular weight PA-12,12 may be extruded with antioxidant employing barrel temperatures ranging between 186° C. and 221° C. with a spinneret temperature of approximately 225° C. Continuous filament yarn of appropriate deniers desirable for various layers of the batt of press felts can be extruded and later crimped and cut into staple fibres for batt manufacture and then employed as batt in press felts.

In another aspect of the invention, the filaments or monofilaments of P.A. 12-12 used in the invention may be drawn after extrusion and then subjected to a relaxation step. As described above, the drawdown may be within the range 2.0x to 4.5x. The relaxation after draw may be within the range 5% to 20%, typically 7% to 15%. Typically, the relaxation will be carried out at an elevated temperature, for example, within the range 130° C. to 160° C.

According to a further aspect of the present invention there is provided a felt for use in a paper making machine comprising of a woven base and at least one layer of batt fibre needle thereto characterised in that the said woven base comprises monofilaments of polyamide-12,12 in at least either the warp direction or the shute direction, said fibres being formed by the extrusion of a melt of polyamide-12,12 having an intrinsic viscosity of not less than 0.65 dl/g measured in concentrated sulfuric acid.

The base materials of the press felts in accordance with the present invention are composed of high molecular weight polyamide-12,12 with appropriate antioxidant. This demonstrates superior durability due to an enhanced recovery from compression and resistance to abrasion. In addition to these advantages, felts in accordance with the invention exhibit superior chemical resistance in particular resistance to hydrolysis and resistance to degradation of physical properties by hypochlorite or other oxidation. Such fibres in press felts exhibit superior durability against the abrasion damage experienced in papers containing fillers such as clay or crushed limestone. Such felts exhibit at least 50 to 100% greater lifetime in use in a particularly hostile chemical and abrasive environments.

Following is a description by way of example only of and with reference to the accompanying drawings of methods of carrying the invention into effect.

Figure 2:
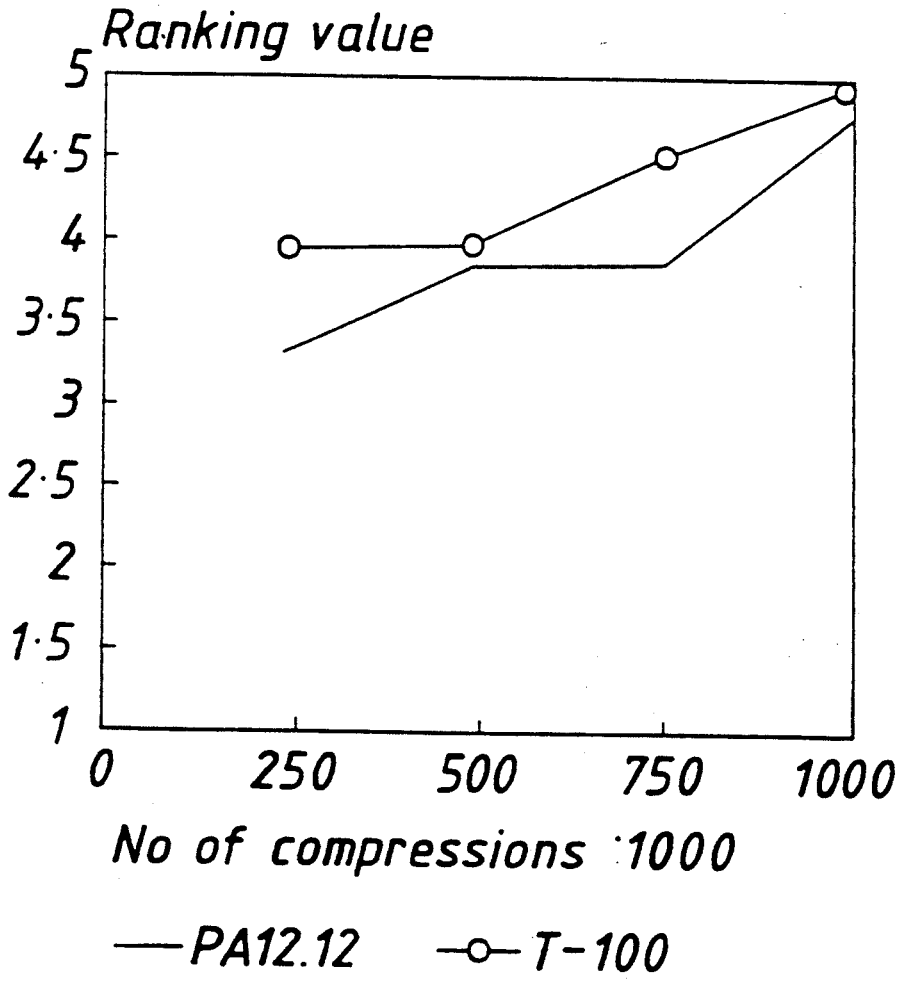

In the drawings:

FIGS. 1 and 2 are graphs showing green felt ranking tests for candidate fibres under varying conditions as described in Example 4.

EXAMPLE 1

Continuous filament yarn of PA-12,12 was prepared according to the following procedure. Commercially available PA-12,12 was purchased as pellets from Dupont, Canada, of intrinsic viscosity 0.68 dl/g in concentrated sulfuric acid. These polyamide pellets were vacuum dried at 77° C. for 16 hours to a final vacuum measured outside the vacuum oven of 160 microns Hg. The pellets were transferred, avoiding absorption of moisture from the air, to a hopper of a single screw extruder. The extruder was equipped with a one inch diameter polyamide screw. The extruder was fitted with a filter pack of 30 micron nominal porosity. Downstream of the filter the extruder was fitted with a Zenith gear pump for metering of the melt to a spinneret. The spinneret had 30 holes, each hole of diameter 0.508 mm. The extruder had a temperature profile ranging from 205° C. at the hopper throat to 265° C. at the pump with 5 zones of independent temperature monitoring and control: The spinneret was maintained at 260° C. Filaments were extruded at approximately 4.2 ft/min with a maximum draw-down such that the radial change was approximately 7–8/1 between spinneret and the first Godet. Yarn was taken up on a cylinder attached to a Leesona winder after the Godet.

A typical as-spun fibre according to this procedure was drawn in two stages each with heat to provide an overall 3.07X draw ratio. The first temperature of drawing was at 105° C. and the second at 160° C. Fibre from such a process was prepared to be approximately 15.0 dpf (denier per filament). Fibre thus prepared had 5.2 tenacity with an initial modulus of 34 gpd and an elongation at break of 45%. The stress-strain curve exhibited a deflection at an elongation of 9% at 3.0 gpd specific stress.

Such fibre was crimped in a heated stuffer box crimper to provide continuous yarn with a variable random crimp with approximately 8–10 crimps/inch. It was cut into staple of approximately 2½ inch length. The fibre was carded, and needled onto an area of an experimental press felt. Such a test area exhibited increased life in comparison to similar PA-6 and 6.6 test areas when challenged with the same oxidizing chemicals in addition to a simulated pressing environment.

EXAMPLE 2

PA-12,12 as described in Example 1 and protected by antioxidant described as a diphenylamine-acetone condensate as made and sold by Uniroyal under the name of Naugard A at a level of 0.7 to 0.8% wt/wt was extruded after drying, to provide monofilaments. Extrusion was accomplished by charging the hopper of a one inch extruder with dried pellets and antioxidant under a blanket of predried nitrogen gas at positive pressure. The polymer was extruded through an orifice of 1.5 mm diameter with a spin-draw of approximately 7 to 1. The extrusion was accomplished by passing the extrudate vertically through a quench tank of water maintained at a temperature of approximately 60° C. The profile in the extruder ranged from a low temperature of approximately 205° C. to the spinneret at approximately 260° C. After passing around the first Godet the fibres were drawn in line in three stages: the first at a temperature of approximately 100° C.; the second approximately 120° C. with a relaxation stage at 160° C. The overall draw ratio was approximately 2.0X. Such fibre was approximately 0.2 mm in diameter and could be used as filaments for the manufacture of forming fabrics.

It was possible in this experiment to vary the conditions of drawing, the degree of drawing, and the crystallinity to obtain filaments appropriate for both shute and warp in forming fabrics. Individual filaments from both warp and shute showed superior abrasion resistance in comparison with PA-6 or 6,6 fibres in the Einlehner test. In this test individual filaments are wrapped around a mandrel which is then forced to suffer abrasion in a slurry of water and china clay at very high speeds for a given period of time. The Einlehner test provides for control samples of competitive fibres to be simultaneously abraded at any stage of abrasion. PA-12,12 monofilaments showed smaller volumetric losses of fibre in comparison with PA-6 or PA-6,6 fibres of the same dimension after each had been identically tested.

EXAMPLE 3

Two grades of DuPont polyamide 12,12 were processed into monofilament by coupled extrusion and drawing. The equipment which was used to produce this product and the process conditions employed are described in Tables 1, 2 and 3. Tensile properties of the resulting product are described in Table 4.

Polyamide 12,12 monofilament offers improved dimensional stability for PMC fibres relative to polyamide 6 and polyamide 6,6 monofilament. This improvement is based upon the combination of high tensile modulus and relative insensitivity to moisture for polyamide 12,12.

TABLE 1

| Monofilament Line Setup | |
|---|---|
| Extruder: | 25 mm Extruder |
| Screw: | Nylon-type screw; I/d = 20/1 |
| Barrel Filter: | 40 mesh screen |
| Extrudate: | Vertical Discharge |
| Pump: | Zenith #1; 0.584 cc/rev. |
| Large Spin Pack | |
| Filter: | Bound screens - 325 over 80 mesh |
| Spinneret: | 8 hole; 0.025" hole diameter; I/d = 3/1 |

TABLE 1-continued

| Monofilament Line Setup | |
|---|---|
| Quench Bath: | Water |
| Draw Line: | 3 forced air ovens with 4 rollstands |

TABLE 2

| Extrusion Conditions | | |
|---|---|---|
| Material: | | L30; IV = 0.68 |
| Lot #: | | 31221 |
| NB Reference: | | #3339-45 |
| PARAMETER | | TYPICAL VALUE |
| Hopper Environment: | | $N^2$ Flush; Hopper Throat Cooled |
| Temperature Profile: | | |
| (feed) | z1: | 370 F. |
| | z2: | 389 F. |
| | z3: | 421 F. |
| extruder exit | z4: | 420 F. |
| (spinneret) | 420 F. | |
| Screw Speed: | | 8.5 rpm |
| Pump Speed: | | 22 rpm |
| Melt Throughput: | | 1.6 $cm^3$/hole/min |
| Melt Pressure: | | |
| After Screw: | | 1300 to 2000 psi |
| After Barrel Filter: | | 600 to 1400 psi |
| After Pump: | | 2500 to 2700 psi |
| Quench Water Temperature: | | 150 F. |
| Air Gap: | | 4 cm |

TABLE 3

| Drawing Parameters | | | | | | | | | |
|---|---|---|---|---|---|---|---|---|---|
| SAMPLE NB#3339- | IV | V1 (fpm) | T1 (°F.) | V2 (fpm) | T2 (°F.) | V3 (fpm) | T3 (°F.) | V4 (fpm) | DRT |
| 45-1 | 1.34 | 30 | 225 | 124 | 250 | 135 | 300 | 135 | 4.50 |
| 45-2 | 1.34 | 30 | 225 | 124 | 250 | 135 | 300 | 119 | 3.95 |
| 45-3 | 1.34 | 30 | 225 | 124 | 250 | 135 | 300 | 127 | 4.23 |
| 45-5 | 1.34 | 30 | 225 | 124 | 250 | 135 | <200 | 135 | 4.50 |

V1 = 1st roll speed; V2 = 2nd roll speed; V3 = 3rd roll speed; V4 = 4th roll speed; T1 = 1st oven temp; T2 = 2nd over temp; T3 = 3rd over temp; DRT = Total Draw Ratio

TABLE 4

| Tensile Properties | | | | | | |
|---|---|---|---|---|---|---|
| Sample No. (NB#3339-) | IV | Total Total Draw Ratio | Denier | Initial Modulus (gpd) | Tenacity (gpd) | Elongation at Break (%) |
| 45-1 | 1.34 | 4.50 | 330 | 52 | 5.5 | 14 |
| 45-2 | 1.34 | 3.95 | 360 | 37 | 4.9 | 19 |
| 45-3 | 1.34 | 4.23 | 346 | 44 | 5.1 | 15 |
| 45-4 | 1.34 | 4.50 | 333 | 48 | 5.3 | 13 |

EXAMPLE 4

Samples of polyamide pellets were vacuum dried for 16 hours at a temperature of 77° C. A sterling 1 inch extruder was set up having a spinneret of 30 holes with diameters of 20 by 0.508 mm and was supplied by Zenith half horse power pump having a capacity 0.297 cc per revolution. Spinning was then conducted using a pump speed of 26 RPMS, a screw speed of 6.9 RPMS, a barrel pressure of 2900 lb per square inch, a pump pressure of 2250 lbs per square inch while maintaining a nitrogen blanket seal on the hopper. No water was used to cool the hopper throat. The temperature profile was such that the temperature was gradually increased from 206° C. in the hopper to approximately 263° C. just prior to the spinneret. After spinning the yarn was withdrawn from the spinneret and then subject to a drawing operation to produce a draw ratio of 3.07:1. In this drawing operation the Godet speed was 150 feet per minute and roll 1 was 150 feet per minute at a roll temperature of 105° C. Roll 2 was at 400 feet per minute and material was drawn over a hot bar at 160° C. while roll 3 was operated at 460 feet per minute. The approximate production rate was 1 lb per hour. The intrinsic viscosity of the resin prior to spinning was 0.68, the intrinsic viscosity of the fibre was 0.63.

All the fibres produced were about 15 denier. The fibre was then formed into standard felt batt samples in which the conditions for production of the batt samples were identical for each sample. In addition a batt sample was prepared for the industry standard polyamide 6 and 6.6.

A composite felt was produced from all the samples and three groups of each sample were prepared. One group of samples was exposed to hydrogen peroxide in a 35% solution buffered to $pH^2$ at 60° C. for a period of 6 hours while a second set of samples were exposed to sodium hypochlorite solution at a temperature of 20° C. for 24 hours buffered to pH 8. The felt was then assembled with the different samples and was installed on an experimental press test machine which was then run continuously with samples being taken initially for evaluation at a ¼ million, ½ million, ¾ million and 1 million compressions. The speed of the press felt was 1000 meters per second and a linear pressure in the press was exerted at 100 kN/m. The felt tension was 3 kN/m and a suction pressure was applied of 40 kPa. The temperature of the water shower sprayed on the felt during running varied between 64° C. to 72° C. and the felt was run until the total number of compressions was 1 million, thereafter the test was discontinued.

Ranking was carried out on cut samples after 250 thousand, 500 thousand and 750 thousand compressions then after completion of the 1 million samples. The ranking values follow a scale of from 1—unaffected to 5—totally damaged. The plots are set out in FIGS. 1, 2 and 3 of the accompanying drawings. Each plot represents an average of four judgements with the exception of the sample after 1 million compressions which is an average of just two samples. This is, however, compensated for by a much larger sample area.

The results shown in FIG. 1 illustrate quite clearly that on the basis of ordinary PA-12,12 samples vis-a-vis the industry standard of DuPont T100 polyamide 6 the results are not particularly outstanding.

When considered after exposure to peroxide, however the sample test indicated above showed a significant and remarkable resistance to degradation compared with the industry standard.

The results shown in FIG. 2 indicates a surprising and entirely unexpected improvement in resistance to degradation.

EXAMPLE 5

Samples of polyamide 12,12 fibres were prepared for use in paper machine clothing applications. Table 1 sets out the Intrinsic Viscocity compared with the sample used in Example 1:

TABLE 5

| Intrinsic Viscosity | | |
|---|---|---|
| Sample Name | Sample No. | Intrinsic Viscosity |
| Polyamide 12,12 (2.7X draw) | 3533-56-1 | 0.67 |
| Polyamide 12,12 (2.7X draw, including 9% relax) | 3533-56-2 | 0.67 |

TABLE 5-continued

| Intrinsic Viscosity | | |
|---|---|---|
| Sample Name | Sample No. | Intrinsic Viscosity |
| Original Polyamide 12,12 (3.07X draw) Example 1 | 3489-97-1 | 0.60 |

Each fiber was spun from the same polyamide resin having an intrinsic viscosity of 0.71 dl/g in concentrated sulfuric acid, into an undrawn, as-spun fiber. From the as-spun fiber, two different drawn samples were produced: one drawn 2.7 X and the second drawn 2.7 X followed by a 9% relaxation step. Both samples were tested for their hydrogen peroxide resistance.

Samples of each, were made up into portions of a test felt as described in Example 4 and at the conclusion of the test the fibres were judged as described in that example. The results are as set out in Table 2 below:

TABLE 6

| Compression Test Data | |
|---|---|
| Sample Name | Test Felt Ranking |
| PA 12,12 (2.7X) 3533-56-1 | 3.3 |
| PA 12,12 (2.7X, 9% relax) 3533-56-2 | 3.3 |
| Original PA 12,12 3489-97-1 | 4.0 |
| Industry TN 12R Standard PA 6 | 3.5 |
| Industry T-100 Standard PA 6,6 | 3.8 |
| HMW PA 12 | 3.3 |

Each high molecular weight polyamide 12,12 fiber was also tested for its hydrogen peroxide resistance as described in Example 4. For comparison, the percent retained intrinsic viscosity was calculated for each sample and listed in Table 3. The data clearly indicates that felts containing polyamide 12,12 fibers in accordance with the invention have superior resistance to hydrogen peroxide than either standard PA 6 or 6,6 fiber, and is comparable to felts containing polyamide 12. Since today's paper making environment is becoming increasingly severe with respect to both chemical, as well as mechanical demands, improved chemical resistance is essential, and is an unexpected property of polyamide 12,12. Hydrogen peroxide data for the original polyamide 12,12 fiber candidate is also listed in Table 3 for reference.

TABLE 7

| Hydrogen Peroxide Resistance | |
|---|---|
| Sample Name | Retained Intrinsic Viscosity % |
| PA 12,12 (2.7X DRAW) 3533-56-1 | 82 |
| PA 12,12 (2.7X, 9% RELAX) 3533-56-2 | 88 |
| Original PA 12,12 3489-97-1 | 87 |
| Grilon TN 12 R Standard PA 6 | 33 |
| Dupont T-100 Standard PA 6,6 | 46 |
| HMW PA 12 | 85 |

We claim:

1. A felt for use in papermaking machines comprising a woven base and at least one batt fibre needled thereto characterised in that at least one of said batt fibre and said woven base comprises fibres of polyamide 12,12 formed by extrusion of a melt of polyamide 12,12 having intrinsic viscosity of not less than 0.65 dl/gram.

2. A felt as claimed in claim 1 characterised in that the melt of polyamide 12,12 contains 0.2 to 1.0% by weight of an antioxidant.

3. A felt as claimed in claim 2 characterised in that the melt of the polyamide 12,12 contained 0.4 to 0.6% by weight of an antioxidant.

4. A felt as claimed in claim 3 characterised in that the antioxidant is selected from one or more of alphatocopherol and related structures, condensation products of diphenylamine and acetone, and of diphenylamine and a compatible phenolic stabliser with amide functionality.

5. A felt as claimed in claim 2 wherein the addition of antioxidant is added at or before extrusion.

6. A felt as claimed in claim 1 characterised in that the felt comprises a woven base including monofilaments of polyamide 12,12 having an intrinsic viscosity of not less than 0.60 dl/gram. in either the warp direction or the shute direction.

7. A felt as claimed in claim 1 wherein filaments or monofilaments of polyamide 12,12 are drawn and subject to a controlled relaxation after drawing.

8. A felt as claimed in claim 7 wherein the relaxation step comprises a relaxation within the range of 5% to 15%.

* * * * *